US005781880A

United States Patent [19]

Su

[11] Patent Number: 5,781,880

[45] Date of Patent: Jul. 14, 1998

[54] PITCH LAG ESTIMATION USING FREQUENCY-DOMAIN LOWPASS FILTERING OF THE LINEAR PREDICTIVE CODING (LPC) RESIDUAL

[75] Inventor: Huan-Yu Su, San Clemente, Calif.

[73] Assignee: Rockwell International Corporation, Newport Beach, Calif.

[21] Appl. No.: 454,477

[22] Filed: May 30, 1995

Related U.S. Application Data

[63] Continuation-in-part of Ser. No. 342,494, Nov. 21, 1994, abandoned.

[51] Int. Cl.[6] ..... G10L 3/02

[52] U.S. Cl. ..... 704/207; 704/217; 704/219

[58] Field of Search ..... 395/2.16, 2.17, 395/2.23, 2.26, 2.28, 2.29; 381/49

[56] References Cited

U.S. PATENT DOCUMENTS 4,989,250 1/1991 Fujimoto et al. ..... 395/2.16

OTHER PUBLICATIONS

Sadaoki Furui, Digital Speech Processing, Synthesis, and Recognition, Dekker, pp. 82,85–87, 1989.

John R. Deller, Jr., John G. Proakis, and John H.L. Hansen, Discrete–Time Processing of Speech Signals, Macmillan, pp. 333–334,355, 1993.

Wolfgang J. Hess, "Pitch and Voicing Determination", in Advances in Speech Signal Processing, edited by Sadaoki Furui and M. Mohan Sondhi, Dekker, p. 15, 1991.

*Primary Examiner*—Allen R. MacDonald
*Assistant Examiner*—Tālivaldis Ivars Šmits
*Attorney, Agent, or Firm*—William C. Cray; Susie H. Oh

[57] ABSTRACT

A pitch estimation device and method utilizing a multi-resolution approach to estimate a pitch lag value of input speech. The system includes determining the LPC residual of the speech and sampling the LPC residual. A discrete Fourier transform is applied and the result is squared. A lowpass filtering step is carried out and a DFT on the squared amplitude is then performed to transform the LPC residual samples into another domain. An initial pitch lag can then be found with lower resolution. After getting the low-resolution pitch lag estimate, a refinement algorithm is applied to get a higher-resolution pitch lag. The refinement algorithm is based on minimizing the prediction error in the time domain. The refined pitch lag then can be used directly in the speech coding.

45 Claims, 8 Drawing Sheets

PITCH LAG ESTIMATION USING FREQUENCY-DOMAIN LOWPASS FILTERING OF THE LINEAR PREDICTIVE CODING (LPC) RESIDUAL

RELATED APPLICATIONS

The present application is a continuation-in-part of application Ser. No. 08/342,494 filed Nov. 21, 1994, abandoned, the disclosure of which is incorporated herein by reference.

BACKGROUND OF THE INVENTION

Signal modeling and parameter estimation play increasingly important roles in data compression, decompression, and coding. To model basic speech sounds, speech signals must be sampled as a discrete waveform to be digitally processed. In one type of signal coding technique, called linear predictive coding (LPC), the signal value at any particular time index is modeled as a linear function of previous values. A subsequent signal is thus linearly predicted according to an earlier value. As a result, efficient signal representations can be determined by estimating and applying certain prediction para meters to represent the signal.

It is recognized that pitch information is a reliable indicator and representative of sounds for coding purposes. Pitch describes a key feature or parameter of a speaker's voice. Because human speech is generally not easily mathematically quantifiable, speech estimation models which can effectively estimate the speech pitch data provide for more accurate and precise coded and decoded speech. In current speech coding models, however, such as certain CELP (e.g., vector sum excited linear prediction (VSELP), multi-pulse, regular pulse, algebraic CELP, etc.) and MBE coder/decoders ("codecs"), pitch estimation is often difficult due to the need for high precision and low complexity of the pitch estimation algorithm.

Several pitch lag estimation schemes are used in conjunction with the above-mentioned codecs: a time domain approach, frequency domain approach, and cepstrum domain approach. The precision of pitch lag estimation has a direct impact on the speech quality due to the close relationship between pitch lag and speech reproduction. In CELP coders, for example, speech generation is based on predictions—long-term pitch prediction and short-term linear prediction. FIG. 1 shows a speech regeneration block diagram of a typical CELP coder. LPC techniques may be used for speech coding involving CELP speech coders which generally utilize at least two excitation codebooks 114. The outputs of the codebooks 114 provide the input to an LPC synthesis filter 110. The output of the LPC synthesis filter can then be processed by an additional postfilter to produce decoded speech, or may circumvent the postfilter and be output directly.

To compress speech data, it is desirable to extract only essential information to avoid transmitting redundancies. Speech can be grouped into short blocks, where representative parameters can be identified in all of the blocks. As indicated in FIG. 1, to generate good quality speech, a CELP speech coder must extract LPC parameters 110, pitch lag parameters 112 (including lag and its associated coefficient), and an optimal innovation code vector 114 with its gain parameter 116 from the input speech to be coded. The coder quantizes the LPC parameters by implementing appropriate coding schemes. The indices of quantization of each parameter comprise the information to be stored or transmitted to the speech decoder. In CELP codecs, determination of pitch prediction parameters (pitch lag and pitch coefficients) is performed in the time domain, while in MBE codecs, pitch parameters are estimated in the frequency domain.

Following LPC analysis, the CELP encoder determines an appropriate LPC filter 110 for the current speech coding frame (usually about 20–40 ms or 160–320 samples at an 8 kHz sampling frequency). The LPC filter is represented by the equation:

$$A(z)=1-a_1z^{-1}-a_2z^{-2}-\ldots-a_{np}z^{-np}$$

or the nth sample can be predicted by $$\hat{y}(n)=\sum_{k=1}^{np} a_k y(n-k)$$

where np is the LPC prediction order (usually approximately 10), y(n) is sampled speech data, and n represents the time index. The LPC equations above describe the estimation of the current sample according to the linear combination of the past samples. The difference between them is called the LPC residual, where:

$$r(n)=y(n)-\hat{y}(n)=y(n)-\sum_{k=1}^{np} a_k y(n-k)$$

A perceptual weighting filter based on the LPC filter which models the sensitivity of the human ear is then defined by:

$$W(z)=\frac{A(z/\gamma_1)}{A(z/\gamma_2)} \quad \text{where } 0<\gamma_2<\gamma_1 \leqq 1$$

The CELP speech coding model includes finding a parameter set which minimizes the energy of the perceptually weighted error signal between the original signal and the resynthesized signal. To address complexity and delay concerns, each speech coding frame is subdivided into multiple subframes. To extract the desired pitch parameters, the pitch parameters which minimize the following weighted coding error energy must be calculated for each coding subframe:

$$d=\|T-\beta P_{Lag}H-\alpha C_iH\|^2$$

where T is the target signal which represents the perceptually filtered input speech signal, and H represents the impulse response matrix of the filter W(z)/A(z). $P_{Lag}$ is the pitch prediction contribution having pitch lag "Lag" and prediction coefficient β which is uniquely defined for a given lag, and $C_i$ is the codebook contribution associated with index i in the codebook and its corresponding gain α. In addition, i takes values between 0 and Nc-1, where Nc is the size of the innovation codebook.

A one-tap pitch predictor and one innovation codebook are assumed. Typically, however, the general form of the pitch predictor is a multi-tap scheme, and the general form of the innovation codebook is a multi-level vector quantization, which utilizes multiple innovation codebooks. More particularly, in speech coding, one-tap pitch predictor indicates that the current speech sample can be predicted by a past speech sample, while the multi-tap predictor means that the current speech sample can be predicted by multiple past speech samples.

Due to complexity concerns, sub-optimal approaches have been used in speech coding schemes. For example, pitch lag estimation may be performed by first evaluating the pitch contribution only (ignoring the codebook contribution)

within the possible lag value range between $L_1$ and $L_2$ samples to cover 2.5 ms–18.5 ms. Consequently, the estimated pitch lag value is determined by maximizing the following:

$$\max_{Lag\in[L_1,L_2]} \frac{(TH^T P_{Lag}^T)^2}{\|P_{Lag}H\|^2} \quad \text{Eqn. (1)}$$

Even though this time domain approach may enable the determination of the real pitch lag, for female speech having a high pitch frequency, the pitch lag found by Eqn. (1) may not be the real lag, but a multiple of the real lag. To avoid this estimation error, additional processes are necessary to correct the estimation error (e.g., lag smoothing) at the cost of undesirable complexity.

However, excess complexity is a significant drawback of using the time domain approach. For example, the time domain approach requires at least 3 million operations per second (MOPs) to determine the lag using integer lag only. Moreover, if pitch lag smoothing and a fractional pitch lag are used, the complexity is more likely about 4 MOPs. In practice, approximately 6 million digital signal processing machine instructions per second (DSP MIPs) are required to implement full range pitch lag estimation with acceptable precision. Thus, it is generally accepted that pitch estimation requires 4–6 DSP MIPs. Although there exist other approaches which can reduce the complexity of pitch estimation, such approaches often sacrifice quality.

In MBE coders, an important member in the class of sinusoidal coders, coding parameters are extracted and quantized in the frequency domain. The MBE speech model is shown in FIGS. 2–4. In the MBE voice encoder/decoder ("vocoder"), described in FIGS. 2 and 3, the fundamental frequency (or pitch lag) 210, voiced/unvoiced decision 212, and spectral envelop 214 are extracted from the input speech in the frequency domain. The parameters are then quantized and encoded into a bit stream which can be stored or transmitted.

In the MBE vocoder, to achieve high speech quality, the fundamental frequency must be estimated with high precision. The estimation of the fundamental frequency is performed in two stages. First, an initial pitch lag is searched within the range of 21 samples to 114 samples to cover 2.6–14.25 ms at the sampling rate of 8000 Hz by minimizing a weighted mean square error equation 310 (FIG. 3) between the input speech 216 and the synthesized speech 218 in the frequency domain. The mean square error between the original speech and the synthesized speech is given by the equation:

$$E = \frac{1}{2\pi}\int_{-\pi}^{\pi} G(\omega)|S(\omega) - \hat{S}(\omega)|d\omega$$

where $S(\omega)$ is the original speech spectrum, $\hat{S}(\omega)$ is the synthesized speech spectrum, and $G(\omega)$ is a frequency-dependent weighting function. As shown in FIG. 4, a pitch tracking algorithm 410 is used to update the initial pitch lag estimate 412 by using the pitch information of neighboring frames.

The motivation for using this approach is based upon the assumption that the fundamental frequency should not change abruptly between neighboring frames. The pitch estimates of the two past and two future neighbor frames are used for the pitch tracking. The mean-square error (including two past and future frames) is then minimized to find a new pitch lag value for the current frame. After tracking the initial pitch lag, a pitch lag multiple checking scheme 414 is applied to eliminate the multiple pitch lag, thus smoothing the pitch lag.

Referring to FIG. 4, in the second stage of the fundamental frequency estimation, pitch lag refinement 416 is employed to increase the precision of the pitch estimate. The candidate pitch lag values are formed based on the initial pitch lag estimate (i.e., the new candidate pitch lag values are formed by adding or subtracting some fractional number from the initial pitch lag estimate). Accordingly, a refined pitch lag estimate 418 can be determined among the candidate pitch lags by minimizing the mean square error function.

However, there are certain drawbacks to frequency domain pitch estimation. First, the complexity is very high. Second, the pitch lag must be searched within the range of 20 and 114 samples covering only 2.5–14.25 ms to limit the window size to 256 samples to accommodate a 256-point FFT. However, for very low pitch frequency talkers, or for speech having a pitch lag beyond 14.25 ms, it is impossible to gather a sufficient number of samples within a 256-sample window. Moreover, only an averaged pitch lag is estimated over a speech frame.

Using cepstrum domain pitch lag estimation (FIG. 5), which was proposed by A. M. Noll in 1967, other modified methods were proposed. In cepstrum domain pitch lag estimation, approximately 37 ms of speech are sampled 510 so that at least two periods of the maximum possible pitch lag (e.g., 18.5 ms) are covered. A 512-point FFT is then applied to the windowed speech frame (at block 512) to obtain the frequency spectrum. Taking the logarithm 514 of the amplitude of the frequency spectrum, a 512-point inverse FFT 516 is applied to get the cepstrum. A weighting function 518 is applied to the cepstrum, and the peak of the cepstrum is detected 520 to determine the pitch lag. A tracking algorithm 522 is then implemented to eliminate any pitch multiples.

Several drawbacks of the cepstrum pitch detection method can be observed, however. For example, the computational requirement is high. To cover the pitch range between 20 and 147 samples at an 8 kHz sampling rate, the 512-point FFT must be performed twice. The precision of the estimate is inadequate since the cepstrum pitch estimate will provide only the estimate of an averaged pitch lag over the analysis frame. However, for low bit rate speech coding, it is critical for the pitch lag value to be estimated over a shorter time period. As a result, the cepstrum pitch estimate is very rarely used for high-quality, low bit rate speech coding. Thus, because of the limitations of each approach mentioned before, a means for efficient pitch lag estimation is desired to meet the needs of high-quality low bit rate speech coding.

SUMMARY OF THE INVENTION

Accordingly, it is an object of the present invention to provide a robust pitch lag estimation system incorporating multi-resolution analysis for speech coding, requiring minimal complexity and greater precision. In particular embodiments, the present invention is directed to a device and method of speech coding using CELP techniques, as well as a variety of other speech coding and recognition systems.

These and other objects are accomplished, according to an embodiment of the invention, by a pitch lag estimation scheme which quickly and efficiently enables the accurate extraction of the real pitch lag, therefore providing good reproduction and regeneration of speech. The pitch lag is extracted for a given speech frame and then refined for each subframe. For every speech frame having N samples of speech, LPC analysis is performed. After the LPC residual signal is obtained, a Discrete Fourier Transform (DFT) is applied to the LPC residual, and the resultant amplitude is squared. A second DFT is then performed. Accordingly, an accurate initial pitch lag for the speech samples within the frame can be determined by a peak searching between the possible minimum value of 20 samples and the maximum lag value of 147 samples at the 8 kHz sampling rate. After obtaining the initial pitch lag estimate, time domain refinement is performed for each subframe to further improve the estimation precision.

DETAILED DESCRIPTION THE PREFERRED EMBODIMENTS

Figure 1:
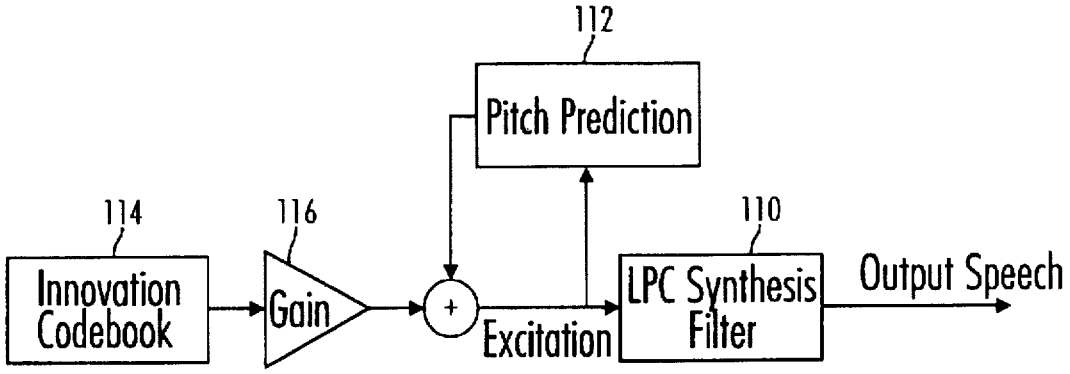
Fig. 1 PRIOR ART
FIG. 1 is a block diagram of a CELP speech model.
Figure 2:
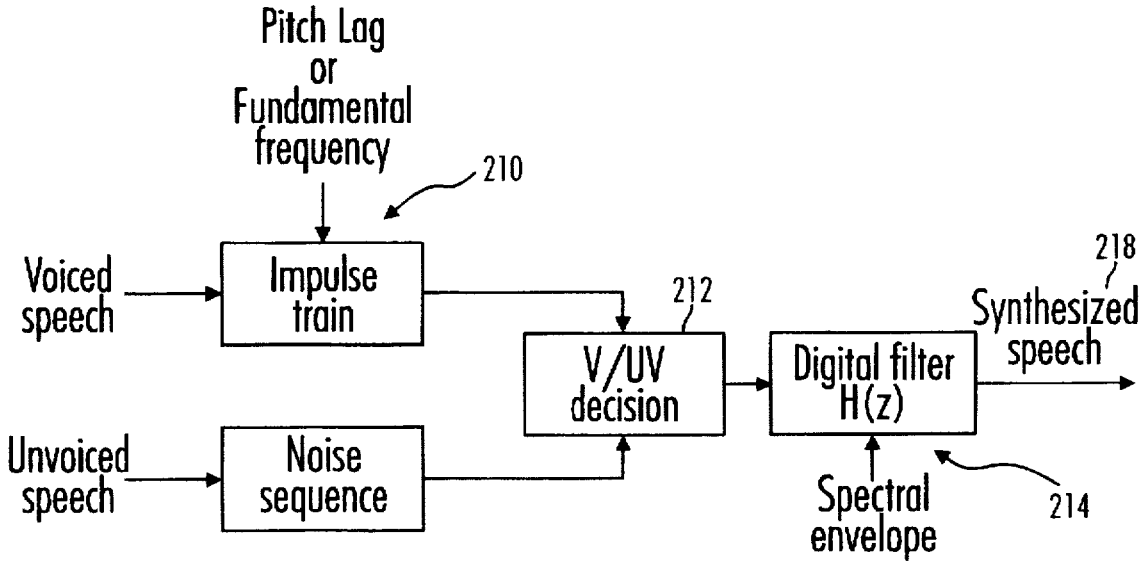
Fig. 2 PRIOR ART
FIG. 2 is a block diagram of an MBE speech model.
Figure 3:
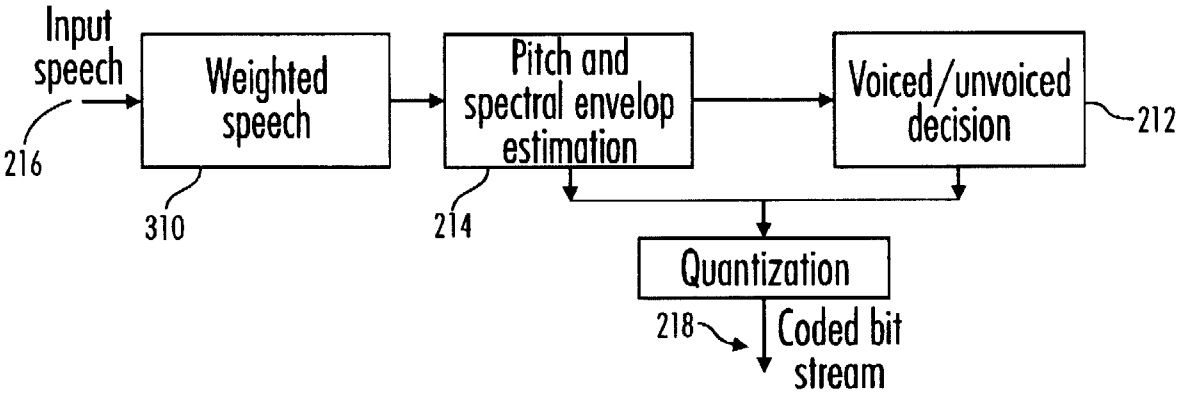
Fig. 3 PRIOR ART
FIG. 3 is a block diagram of an MBE encoder.
Figure 4:
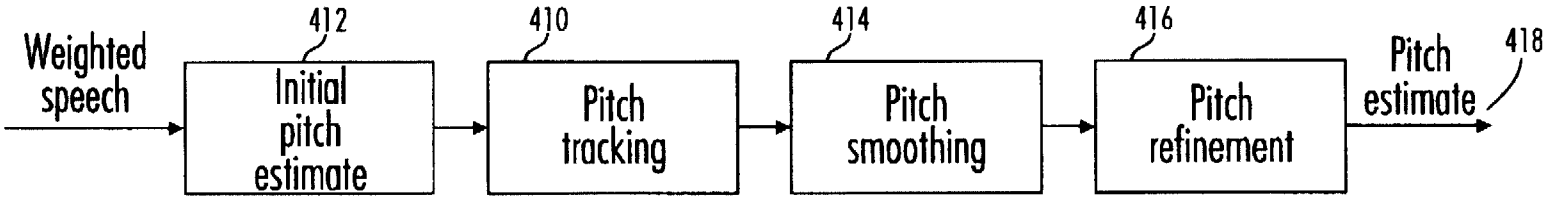
Fig. 4 PRIOR ART
FIG. 4 is a block diagram of pitch lag estimation in an MBE vocoder.
Figure 5:
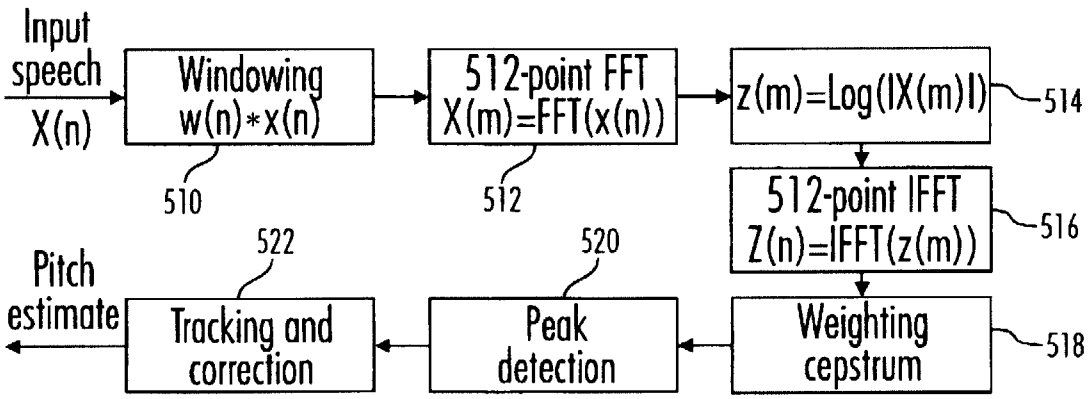
Fig. 5 PRIOR ART
FIG. 5 is block diagram of a cepstrum-based pitch lag detection scheme.
Figure 6:
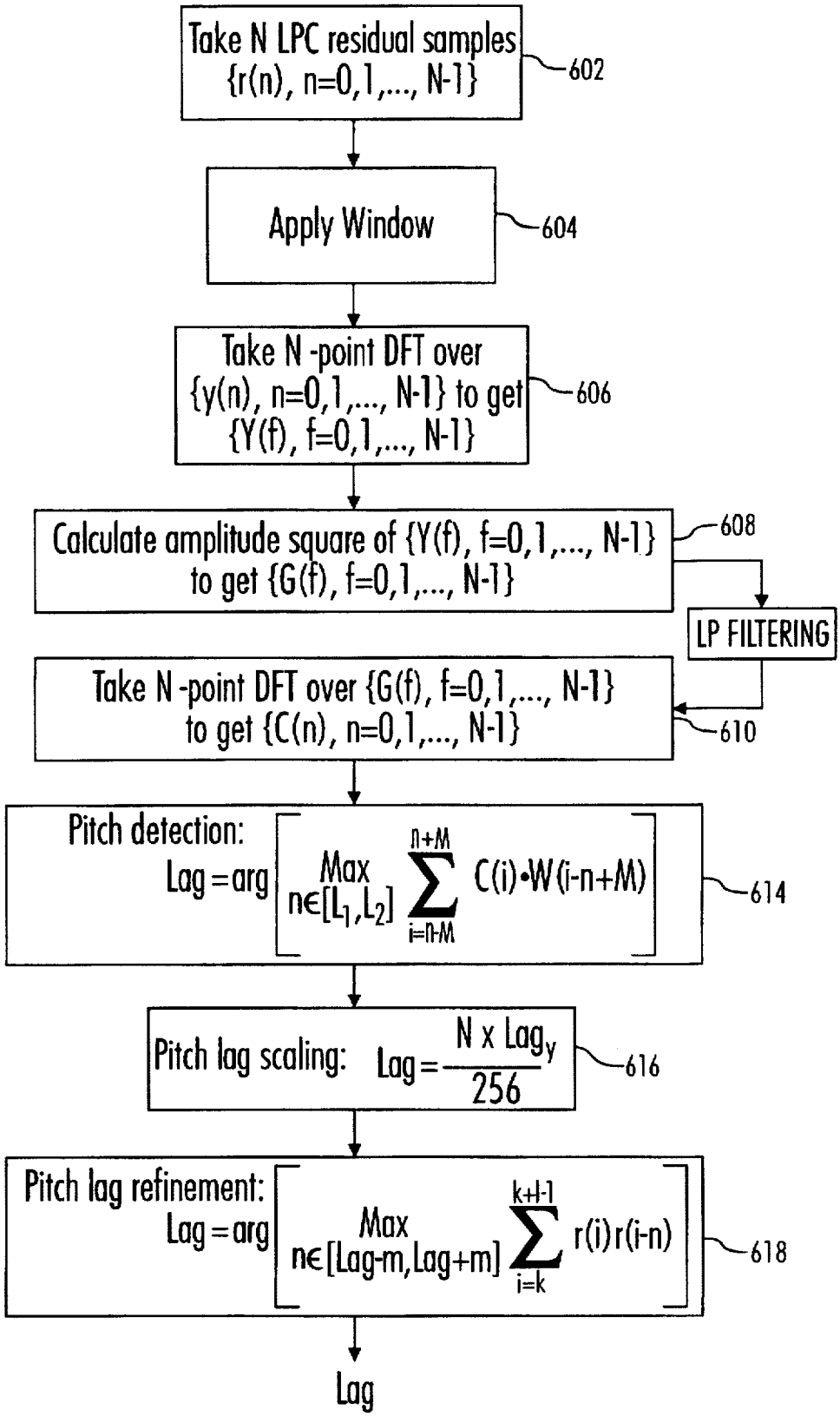
FIG. 6 is an operational flow diagram of pitch lag estimation according to an embodiment of the present invention.
Figure 7A:
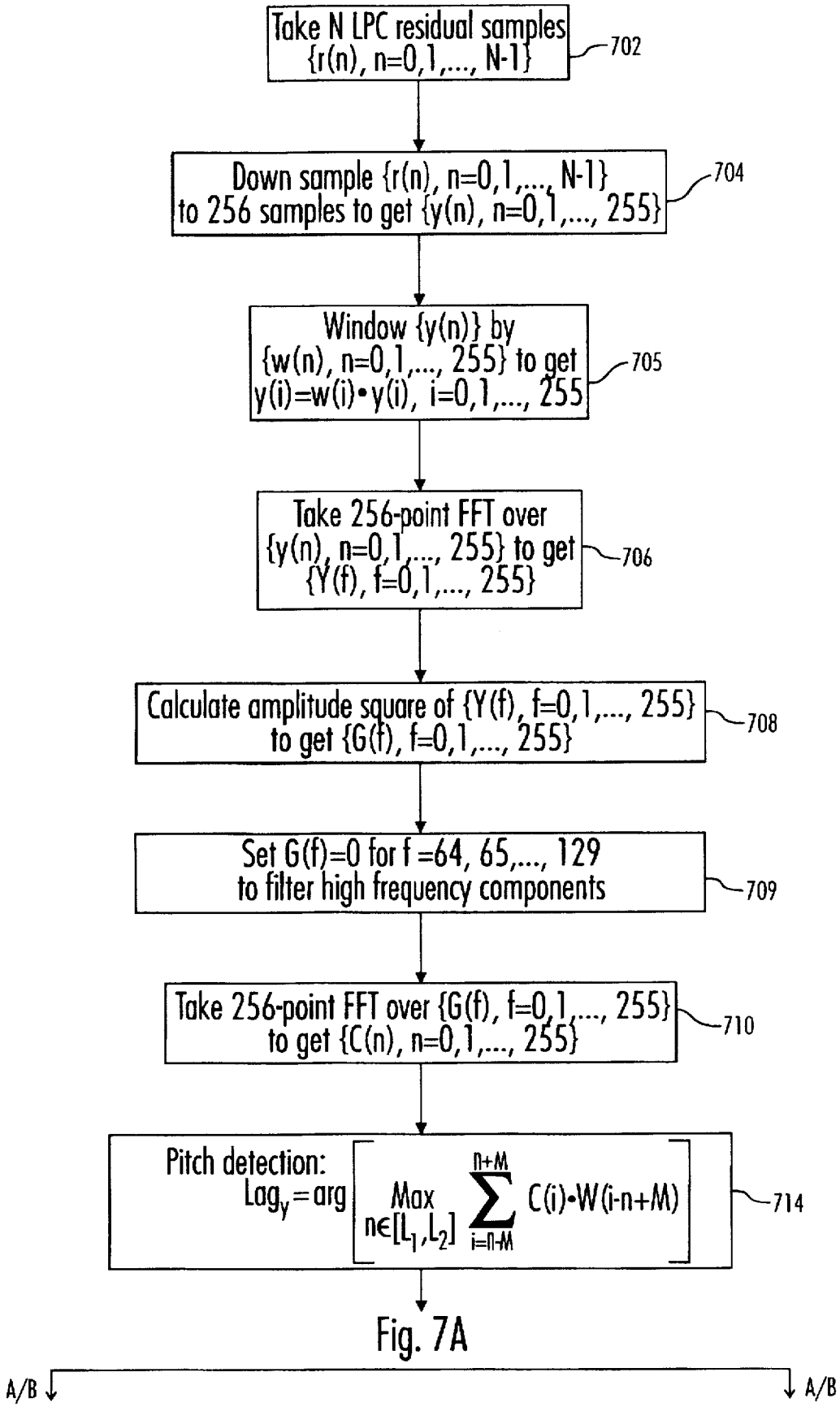
FIG. 7 is a flow diagram of pitch lag estimation according to another embodiment of the present invention.
Figure 7B:
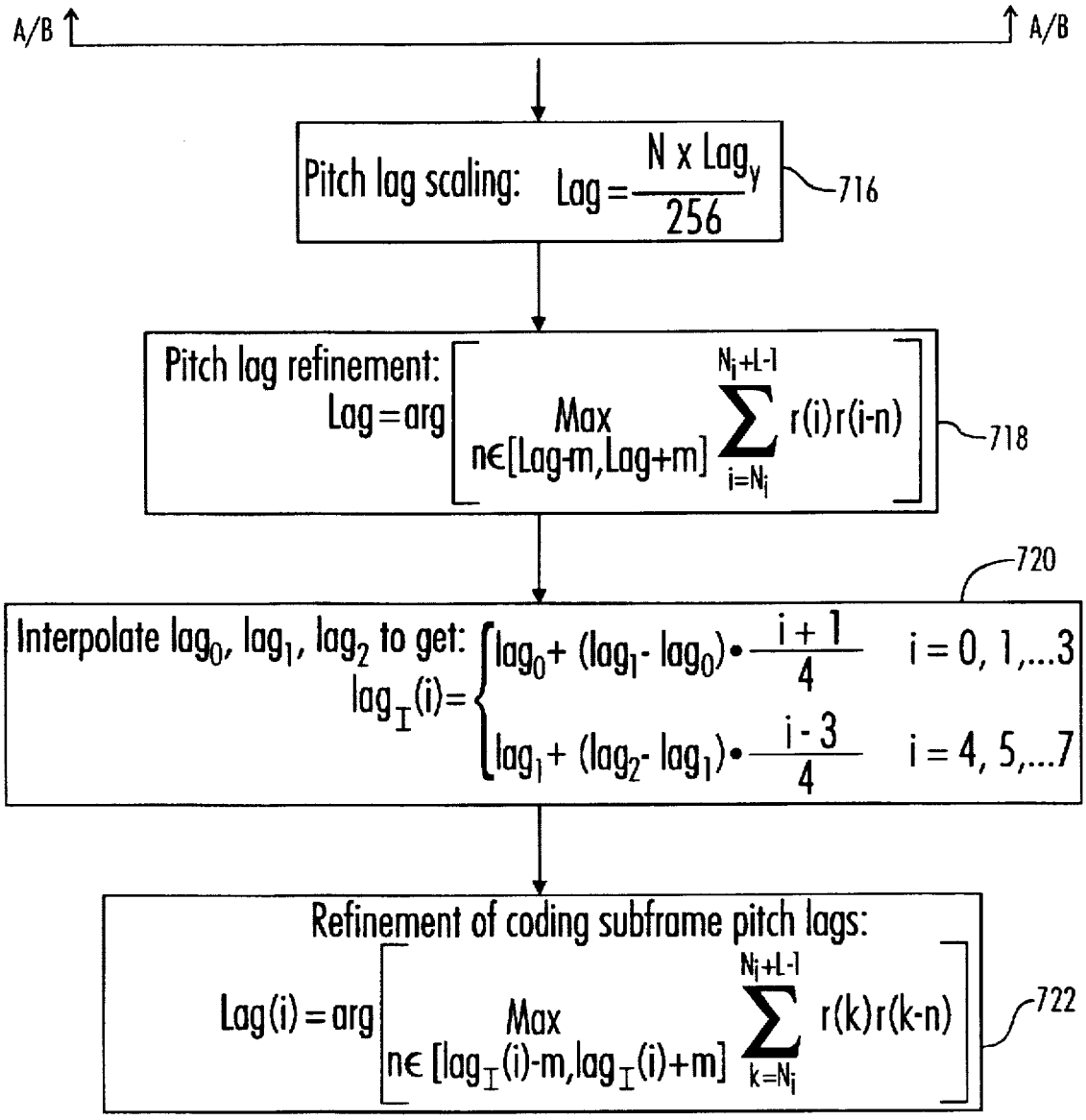
Figure 8:
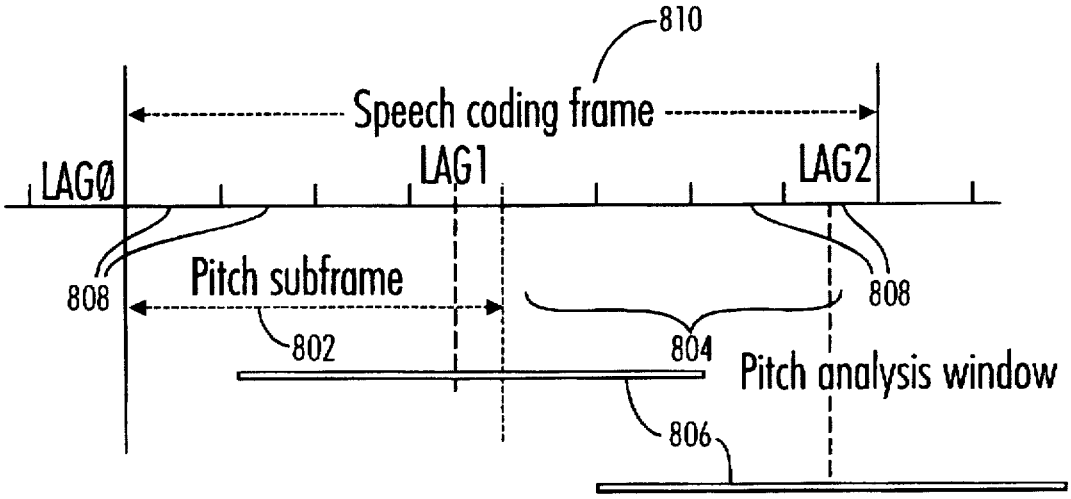
FIG. 8 is a diagrammatic view of speech coding according to the embodiment of FIG. 6.

A pitch lag estimation scheme in accordance with a preferred embodiment of the present invention is described generally in FIGS. 6, 7, and 8. According to an embodiment of the present invention, as indicated in FIG. 6, pitch lag estimation is performed on the LPC residual, rather than the original speech itself. First, N speech samples {x(n), n=0 . . . , N-1} are gathered (step 602 of FIG. 6), and inverse LPC filtering is performed to obtain the LPC residual signal. The value of N is determined according to the maximum pitch lag allowed, wherein at least two periods of the maximum pitch lag are generally required to generate the speech spectrum with pitch harmonics. For example, N may equal 320 samples to accommodate a maximum pitch lag of 150 samples. Thus, N must be greater than twice the maximum possible pitch lag, where {r(n), n=0, 1, . . . , N-1} represents the LPC residual signal. In addition, in preferred embodiments, a Hamming window 604, or other window which covers the N samples is implemented.

An N-point DFT is applied in step 606 over {r(n), n=0, 1, . . . , N-1} to get {Y(f), f=0, 1, . . . , N-1}, where:

$$Y(f)=\sum_{n=0}^{N-1} r(n)e^{-j2\pi fn/N} \quad \text{for } f=0,1,\ldots,N-1. \qquad \text{Eqn. (2)}$$

Y(f) is then squared in step 608 according to:

$$G(f)=|Y(f)|^2 \text{ for } f=0,1,\ldots,N-1 \qquad \text{Eqn. (3).}$$

Lowpass filtering is carried out in step 609 and then a second N-point DFT is applied to G(f) in Step 610 to obtain $$C(n)=\sum_{f=0}^{N-1} G(n)e^{-j2\pi fn/N} \quad \text{for } n=0,1,\ldots,N-1. \qquad \text{Eqn. (4)}$$

It will be recognized that, according to embodiments of the present invention, C(n) is unlike the conventional cepstrum transformation in which the logarithm of G(f) is used in Eqn. (4) rather than the function G(f). An inverse DFT, rather than another DFT, is then applied to G(f). This difference is generally attributable to complexity concerns. One way to reduce complexity is to eliminate the logarithmic function, which otherwise requires substantially greater computational resources. In addition, upon comparison of pitch lag estimation schemes using cepstrum or the C(n) function, varying results have been obtained only for unvoiced or transition segments of the speech. For example, for unvoiced or transition speech, the definition of pitch is unclear. It has been said that there is no pitch in transition speech, while others say that some prediction can always be designated to minimize the error.

Accordingly, once C(n) is determined (step 610), the pitch lag for the given speech frame can be found in step 614 by solving the following:

$$\text{Lag}=arg\left[\max_{n\in[L_1,L_2]}\sum_{i=n-M}^{n+M} C(i)\cdot W(i-n+M)\right] \qquad \text{Eqn. (5)}$$

where arg [•] determines the variable n which satisfies the internal optimization function, $L_1$ and $L_2$ are defined as the minimum and maximum possible pitch lags, respectively. For speech coding convenience, it is desirable for the difference between $L_2$ and $L_1$ to be a power of 2 for the binary representation. In preferred embodiments, $L_1$ and $L_2$ take values of 20 and 147, respectively, to cover the typical human speech pitch lag range of 2.5 to 18.375 ms, where the distance between $L_1$ and $L_2$ is a power of 2. W(i) is a weighting function, and 2M+1 represents the window size. Preferably, {W(i)=1, i=0, 1, . . . , 2M}, and M=1.

Although the resultant pitch lag is an averaged value, it has been found to be reliable and accurate. The averaging effect is due to the relatively large analysis window size; for a maximum allowed lag of 147 samples, the window size should be at least twice as large as the lag value. Undesirably, however, with such a large window, signals from some voices, such as female talkers who typically display a small pitch lag, may contain 4–10 pitch periods. If there is a change in the pitch lag, the proposed pitch lag estimation only produces an averaged pitch lag. As a result, the use of such an averaged pitch lag in speech coding could cause severe degradation in speech estimation and regeneration.

Due to relatively quick changes of pitch information in speech, most speech coding systems based on the CELP model evaluate and transmit the pitch lag once per subframe. Thus, in CELP type speech coding in which one speech frame is divided into several subframes which are typically 2–10 ms long (16–80 samples), pitch lag information is updated in each of the subframes. Accordingly, correct pitch lag values are needed only for the subframes. The pitch lag estimated according to the above scheme, however, does not have sufficient precision for accurate speech coding due to the averaging effect.

One way to refine the pitch lag for each subframe is to use the estimated lag as a reference and do a time domain lag search such as the convention CELP analysis-by-synthesis. A reduced searching range (±5 samples have been found to be sufficient) which is centered around the estimated lag value could then be implemented. In particular embodiments of the invention, to improve the estimation precision, a refined search based on the initial pitch lag estimate may be performed in the time domain (Step 618). A simple autocorrelation method is performed around the averaged Lag value for the particular coding period, or subframe:

$$\text{Lag} = arg\left[\max_{n\in[\text{Lag}-m,\text{Lag}+m]} \sum_{i=k}^{k+l-1} x(i)\cdot x(i-n)\right] \quad \text{Eqn. (6)}$$

where arg |•| determines the variable n which satisfies the inside optimization function, k denotes the first sample of the subframe, 1 represents the refine window size and m is a searching range. To determine an accurate pitch lag value, the refine window size should be at least one pitch period. The window, however, should not be too large to avoid the effects of averaging. For example, preferably, 1=Lag+10, and m=5. Thus, according to the time domain refinement of Eqn. 6, a more precise pitch lag can be estimated and applied to the coding of the subframe.

In operation, although the Fast Fourier Transform (FFT) is sometimes more computationally efficient than the general DFT, the drawback of using an FFT is that the window size must be power of 2. For example, it has been shown that the maximum pitch lag of 147 samples is not a power of 2. To include the maximum pitch lag, a window size of 512 samples is necessary. However, this results in a poor pitch lag estimation for female voices due to the averaging effect, discussed above, and the large amount of computation required. If a window size of 256 samples is used, the averaging effect is reduced and the complexity is less. However, to use such a window, a pitch lag larger than 128 samples in the speech cannot be accommodated.

To overcome some of these problems, an alternative preferred embodiment of the present invention utilizes a 256-point FFT to reduce the complexity, and employ a modified signal to estimate the pitch lag. The modification of the signal is a down sampling process. Referring to FIG. 7, N LPC residual samples are gathered (Step 702), with N being greater than twice the maximum pitch lag, {x(n), n=0, 1, . . . , N-1}. The N samples are then down-sampled into 256 new analysis samples (Step 704) using linear interpolation, according to:

$$y(i)=r([i\cdot\lambda])+\{r([i\cdot\lambda]+1)-r([i\cdot\lambda])\}(i\cdot\lambda-[i\cdot\lambda]) \text{ for } i=0, 1, \ldots, 255$$

where λ=N/256, and the values within the brackets, i.e., [i•λ], denote the largest integer value not greater than i•λ. A Hamming window, or other window, is then applied to the interpolated data in step 705.

In step 706, the pitch lag estimation is performed over y(i) using a 256-point FFT to generate the amplitude Y(f). Steps 708, 709, and 710 are then carried out similarly to those described with regard to FIG. 6. In addition, however, G(f) is filtered (step 709) to reduce the high frequency components of G(f) which are not useful for pitch detection. Once the lag of y(i), i.e., $\text{Lag}_y$, is found (step 714) according to Eqn. (5), it is rescaled in step 716 to determine the pitch lag estimate:

$$\text{Lag}=\text{Lag}_y\cdot\lambda$$

In summary, as illustrated in FIG. 8, the above procedure to find an initial pitch estimate for the coding frame is as follows:

(1) subdividing the standard 40 ms coding frame into pitch subframes 802 and 804, each pitch subframe being approximately 20 ms long;

(2) taking N=320 LPC residual samples such that the pitch analysis window 806 is positioned at the center of the last subframe, and find the lag for that subframe using the proposed algorithm; and (3) determining initial pitch lag values for the pitch subframes.

Pitch lag refinement is then performed in step 718 over the original speech samples. As noted above, refinement using the analysis-by-synthesis method on the weighted speech samples may also be employed. Thus, in embodiments of the present invention, pitch lag values can be accurately estimated while reducing complexity, yet maintaining good precision. Using FFT embodiments of the present invention, there is no difficulty in handling pitch lag values greater than 120. First, for example, the 40 ms coding frame 810 is divided into eight 5 ms coding subframes 808, as shown in FIG. 8. Initial pitch lag estimates $\text{lag}_1$ and $\text{lag}_2$ are the lag estimates for the last coding subframe 808 of each pitch subframe 802, 804 in the current coding frame. $\text{Lag}_0$ is the refined lag estimate of the second pitch subframe in the previous coding frame. The relationship among $\text{lag}_1$, $\text{lag}_2$, and $\text{lag}_0$ is shown in FIG. 8.

The pitch lags of the coding subframes are estimated by linearly interpolating $\text{lag}_1$, $\text{lag}_2$, and $\text{lag}_0$. The precision of the pitch lag estimates of the coding subframes is improved by refining the interpolated pitch lag of each coding subframe. If {$\text{lag}_1$(i), i=0, 1, . . . , 7} represents the interpolated pitch lags of coding subframes based on the refined initial pitch estimates $\text{lag}_1$, $\text{lag}_2$, and $\text{lag}_0$, $\text{lag}_1$(i) is determined by:

$$\text{lag}_i(i) = \begin{cases} \text{lag}_0 + (lag_1 - lag_0) * \frac{i+1}{4} & i = 0,1,2,3 \\ \text{lag}_1 + (lag_2 - lag_1) * \frac{i-3}{4} & i = 4,5,6,7 \end{cases}$$

Because the precision of the pitch lag estimates given by linear interpolation is not sufficient, further improvement may be required. For the given pitch lag estimates {$\text{lag}_1$,(i), i=0, 1, . . . , 7}, each $\text{lag}_1$(i) is further refined (step 722) by:

$$\text{lag}_i = arg\left[\max_{n\in[\text{lag}_i(i)-M,\text{lag}_i(i)+M]} \sum_{k=Ni}^{Ni+L-1} x(k)\cdot x(k-n)\right]$$

for $i = 0,1, \ldots ,7$ where $N_i$ is the index of the starting sample in the coding subframe for pitch lag(i). In the example, M is chosen to be 3, and L equals 40.

In another form of refinement, the analysis-by-synthesis method is combined with a reduced lag search about the interpolated lag value for each subframe. If the speech coding frame is sufficiently short, e.g., less than 20 ms), the pitch estimation window may be placed about the middle of the coding frame, such that further interpolation is not necessary.

The linear interpolation of pitch lag is critical in unvoiced segments of speech. The pitch lag found by any analysis method tends to be randomly distributed for unvoiced speech. However, due to the relatively large pitch subframe size, if the lag for each subframe is too close to the initially determined subframe lag (found in step (2) above), an undesirable artificial periodicity that originally was not in the speech is added. In addition, linear interpolation provides a simple solution to problems associated with poor quality unvoiced speech. Moreover, since the subframe lag tends to be random, once interpolated, the lag for each subframe is also very randomly distributed, which guarantees voice quality.

Figure 9A:
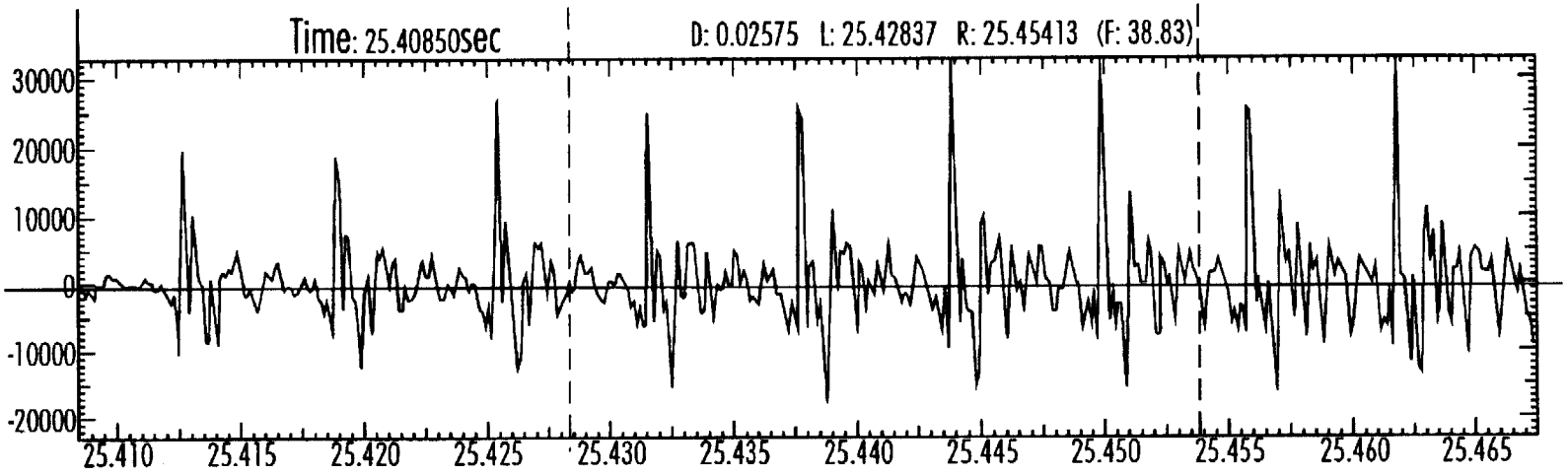
FIGS. 9(*a*)–(*c*) show various graphical representations of speech signals.
Figure 9B:
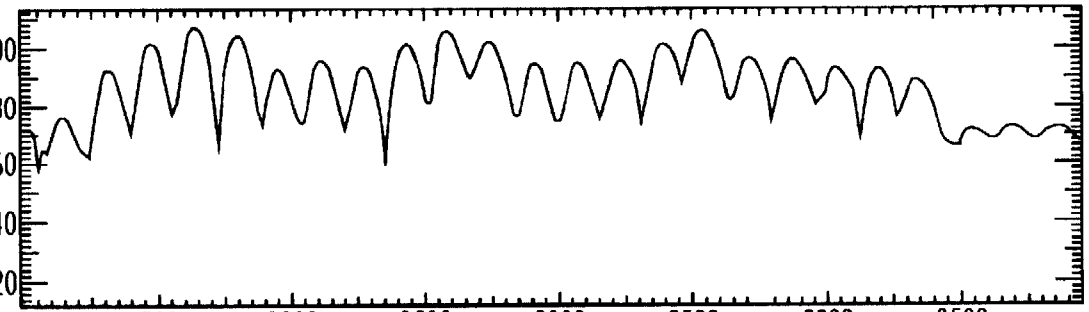
Figure 9C:
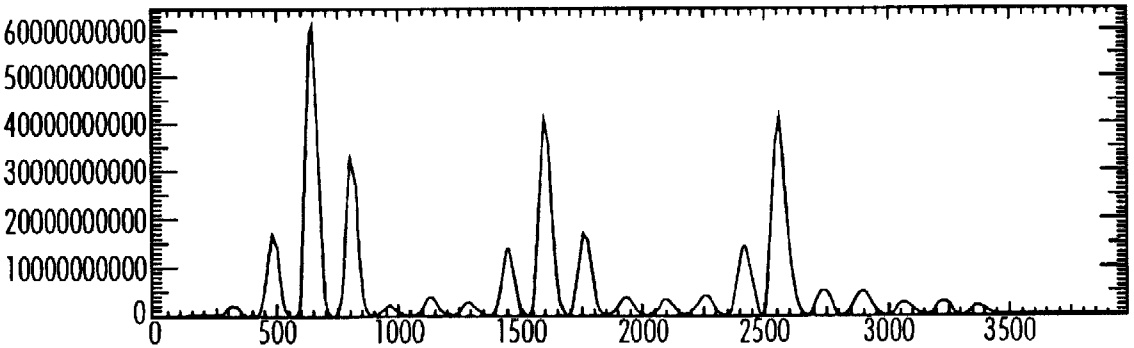

Thus, utilizing the LPC residual to estimate the pitch lag can be advantageous. FIG. 9(*a*) represents an example distribution of plural speech samples. The resultant power spectrum of the speech signals is illustrated in FIG. 9(*b*), and the graphical representation of the square of the amplitude of the speech is shown in FIG. 9(*c*). As shown in the figures, the pitch harmonics displayed in FIG. 9(*b*) are not reflected in FIG. 9(*c*). Due to the LPC gain, an undesirable 5–20 dB difference may exist between the fine structure of the pitch of the speech signal and each formant. Consequently, although the formants in FIG. 9(*c*) do not accurately represent the pitch structure, but still appear to indicate a consistent fundamental frequency at the peak structures, errors may occur in the estimation of the pitch lag.

Figure 10A:
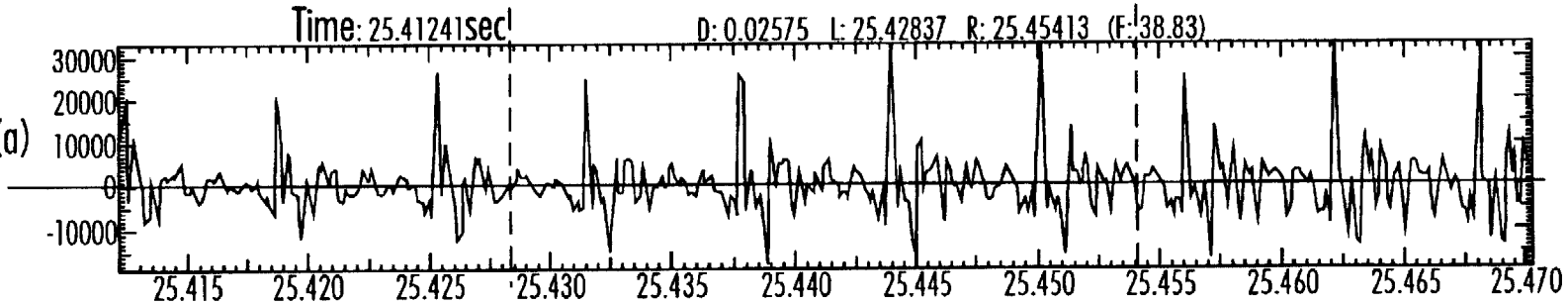
FIGS. 10(*a*)–(*c*) show various graphical representations of LPC residual signals according to an embodiment of the present invention.
Figure 10B:
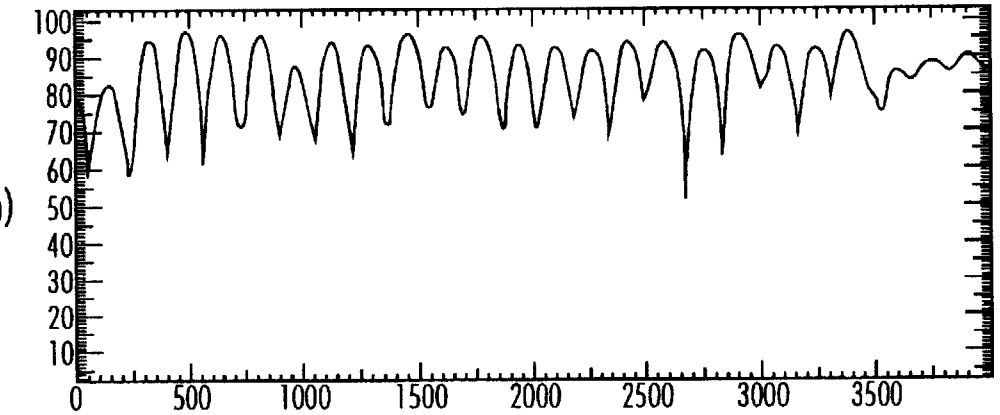
Figure 10C:
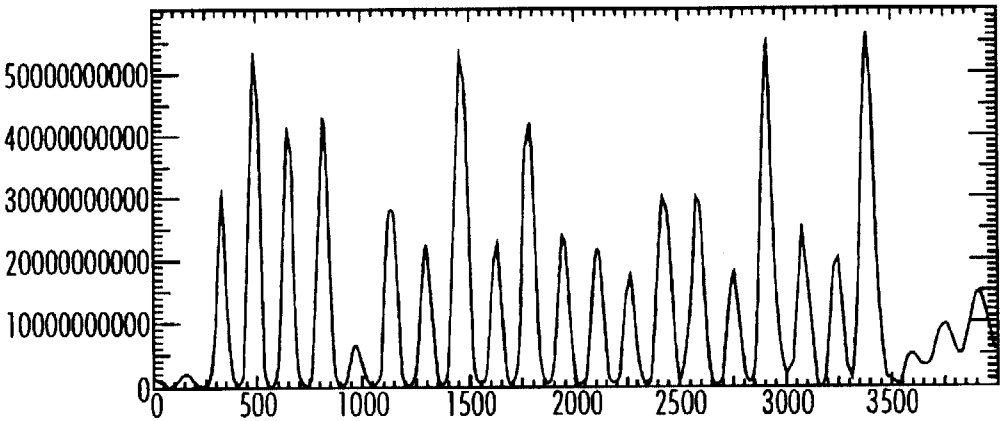

In contrast to the speech signal spectrum, the LPC residual of the original speech samples provides a more accurate representation of the square of the amplitudes (FIG. 10(*c*)). As shown in FIGS. 10(*a*) and 10(*b*), the LPC residual and the logarithm of the square of the amplitudes of the LPC residual samples, respectively, display similar characteristics in peak and period. However, it can be seen in FIG. 10(*c*), that the graphical depiction of the square of the amplitudes of the LPC residual samples shows significantly greater definition and exhibits better periodicity than the original speech signal.

What is claimed is:

1. A system for estimating pitch lag for speech quantization and compression requiring substantially reduced complexity, the speech having a linear predictive coding (LPC) residual signal defined by a plurality of LPC residual samples, wherein the estimate of a current LPC residual sample is determined in the time domain according to a linear combination of past samples, further wherein the speech represents voiced and unvoiced speech falling within a typical frequency range having a fundamental frequency, the system comprising:

means for applying a first discrete Fourier transform (DFT) to the plurality of LPC residual samples, the first DFT having an associated amplitude;

means for squaring the amplitude of the first DFT, the squared amplitude having high and low frequency components;

a filter for filtering out the high frequency components of the squared amplitude in the frequency domain, thereby providing for substantially reduced system complexity, wherein frequencies between zero and at least two times the typical frequency range of the speech are retained to ensure that at least one harmonic is obtained to prevent confusion in detecting the fundamental frequency;

means for applying a second DFT directly over the squared amplitude without taking the logarithm of the squared amplitude, the second DFT having associated quasi-time domain-transformed samples; and means for determining an initial pitch lag value according to the time domain-transformed samples.

2. The system of claim 1, wherein the initial pitch lag value has an associated prediction error, the system further comprising means for refining the initial pitch lag value, wherein the associated prediction error is minimized.

3. The system of claim 1, further comprising a low pass filter for filtering out high frequency components of the amplitude of the first DFT.

4. The system of claim 1, further comprising:

means for grouping the plurality of LPC residual samples into a current coding frame;

means for dividing the coding frame into multiple pitch subframes;

means for subdividing the pitch subframes into multiple coding subframes;

means for estimating initial pitch lag estimates $lag_1$ and $lag_2$ which represent the lag estimates, respectively, for the last coding subframe of each pitch subframe in the current coding frame;

means for estimating pitch lag estimate $lag_0$ which represents the lag estimate for the last coding subframe of the previous coding frame;

means for refining the pitch lag estimate $lag_0$;

means for linearly interpolating $lag_1$, $lag_2$, and $lag_0$ to estimate pitch lag values of the coding subframes; and means for further refining the interpolated pitch lag of each coding subframe.

5. The system of claim 1, further comprising means for downsampling the speech samples to a downsampling value for approximate representation by fewer samples.

6. The system of claim 5, wherein the initial pitch lag value is scaled according to the equation:

$$Lag_{scaled} = \frac{\text{Number } LPC \text{ residual samples}}{\text{Downsampling value}} * \text{Estimated pitch lag.}$$

7. The system of claim 1, wherein the means for refining the initial pitch lag value comprises autocorrelation.

8. The system of claim 1, further comprising:

speech input means for receiving the input speech;

means for determining the LPC residual signal of the input speech;

a computer for processing the initial pitch lag value to reproduce the LPC residual signal as coded speech; and speech output means for outputting the coded speech.

9. A system operable with a computer for estimating pitch lag for input speech quantization and compression requiring substantially reduced complexity on the order of three times less complexity than standard pitch detection methods, the speech having a linear predictive coding (LPC) residual signal defined by a plurality of LPC residual samples, wherein the estimated pitch lag falls within a predetermined minimum and maximum pitch lag value range, further wherein the speech represents voiced and unvoiced speech within a typical frequency range having a fundamental frequency, the system comprising:

means for selecting a pitch analysis window among the LPC residual samples, the pitch analysis window being at least twice as large as the maximum pitch lag value;

means for applying a first discrete Fourier transform (DFT) to the windowed plurality of LPC residual samples, the first DFT having an associated amplitude spectrum, the amplitude spectrum having low and high frequency components;

a filter for filtering out the high frequency components of the amplitude spectrum in the frequency domain, thereby providing for substantially reduced system complexity, wherein frequencies between zero and at least two times the typical frequency range of the speech are retained to ensure that at least one harmonic is detected to prevent confusion in detecting the fundamental frequency;

means for applying a second DFT directly over the amplitude spectrum of the first DFT without taking the logarithm of the squared amplitude, the second DFT being a 256-point DFT and having associated quasi-time domain-transformed samples such that the quasi-time domain-transformed samples are real values;

means for applying a weighted average to the time domain-transformed samples, wherein at least two samples are combined to produce a single sample;

means for searching the time-domain transformed speech samples to find at least one sample having a maximum peak value; and means for estimating an initial pitch lag value according to the sample having the maximum peak value.

10. The apparatus of claim 9, further comprising means for applying a homogeneous transformation to the amplitude of the first DFT.

11. The apparatus of claim 9, wherein the amplitude of the first DFT is squared.

12. The apparatus of claim 9, wherein the logarithm of the amplitude of the first DFT is used.

13. The system of claim 9, further comprising means for applying a Hamming window to the LPC residual samples before applying the first DFT.

14. The system of claim 9, wherein three time domain-transformed samples are combined.

15. The system of claim 9, wherein an odd number of time domain-transformed samples are combined.

16. The system of claim 9, further comprising:

means for grouping the plurality of LPC residual samples into a current coding frame; and means for estimating an initial pitch lag value over the pitch analysis window, wherein the estimated pitch lag is the pitch lag value of the current coding frame.

17. The system of claim 16, further comprising:

means for linearly interpolating the pitch lag estimates of the current coding frame to provide an interpolated pitch lag value; and means for refining the interpolated pitch lag value of each coding frame, wherein a peak search is performed within a searching range of ±5 samples of the initially estimated pitch lag value.

18. The system of claim 9, further comprising means for downsampling the speech samples to a downsampling value for approximate representation by fewer samples, wherein the initial pitch lag value is scaled according to the equation:

$$\mathrm{Lag}_{scaled} = \frac{\text{Number } LPC \text{ residual samples}}{\text{Downsampling value}} * \text{Estimated initial pitch lag.}$$

19. The system of claim 9, further comprising:

speech input means for receiving the input speech;

means for determining the LPC residual signal of the input speech;

a processor for processing the initial pitch lag value to represent the LPC excitation signal as coded speech; and speech output means for outputting the coded speech.

20. A speech coding apparatus for reproducing and coding input speech represents voiced and unvoiced speech within a typical frequency range of zero to 800 Hz having a fundamental frequency, the apparatus requiring substantially reduced complexity on the order of three times less complexity than standard autocorrelation methods, wherein the speech coding apparatus is operable with a linear predictive coding (LPC) excitation signal defining the decoded LPC residual of the input speech, LPC parameters, and an innovation codebook representing a plurality of vectors which are referenced to excite speech reproduction to generate speech, the speech coding apparatus comprising:

a computer for processing the LPC residual, wherein the computer includes;

means for segregating a current coding frame within the LPC residual, means for dividing the coding frame into plural pitch subframes, means for defining a pitch analysis window having N LPC residual samples, the pitch analysis window extending across the pitch subframes, means for estimating an initial pitch lag value for each pitch subframe, including means for applying a first discrete Fourier transform (DFT) to the N LPC residual samples, the first DFT having an associated amplitude, means for squaring the amplitude of the first DFT, the squared amplitude having high and low frequency components, a filter for filtering out the high frequency components of the squared amplitude in the frequency domain, thereby providing for substantially reduced system complexity, wherein frequencies between zero and a least 1.6 kHz, equivalent to two times the typical frequency range of the speech, are retained to ensure that a least one harmonic is obtained to prevent confusion in determining the fundamental frequency, means for applying a second DFT directly over the squared amplitude without taking the logarithm of the squared amplitude, the second DFT being a 256-point DFT and having associated quasi-time domain-transformed samples such that the quasi-time domain-transformed samples are real values, means for dividing each pitch subframe into multiple coding subframes, wherein the initial pitch lag estimates for each pitch subframe represents the lag estimates for the last coding subframe of each pitch subframe in the current coding frame, means for linearly interpolating the estimated pitch lag values between the pitch subframes to determine a pitch lag estimate for each coding subframe, and means for refining the linearly interpolated lag values of each coding subframe; and speech output means for outputting speech reproduced according to the refined pitch lag values.

21. The apparatus of claim 20, wherein the DFT has an associated length, and computer further includes means for downsampling the N LPC residual samples for representation by fewer samples, and means for scaling the pitch lag value such that the scaled lag value $$\mathrm{Lag}_{scaled} = \frac{N}{X} * \text{Estimated pitch lag value,}$$

wherein X is determined according to the length of the DFT.

22. The apparatus of claim 20, wherein each coding frame has a length of approximately 40 ms.

23. A speech coding apparatus for reproducing and coding input speech representing voiced and unvoiced speech within a typical frequency range of zero to 800 Hz having a fundamental frequency, the apparatus requiring substantially reduced complexity on the order of 1 million instructions per second (MIPS), three times less complexity than standard autocorrelation methods requiring at least 3 MIPS, the input speech being filtered by an inverse linear predictive coding (LPC) filter to obtain the LPC residual of the input speech, the speech coding apparatus comprising:

a computer for processing the LPC residual and estimating an initial pitch lag of the LPC residual, wherein the pitch lag is between a minimum and maximum pitch lag value, the computer including means for defining a current pitch analysis window having N LPC residual samples, wherein N is a least two times the maximum pitch lag value, means for applying a 256-point first discrete Fourier transform (DFT) to the LPC residual samples in the current pitch analysis window, the first DFT having an associated amplitude spectrum, the amplitude spectrum having high and low frequency signals, filter for filtering out the high frequency signals of the amplitude spectrum in the frequency domain, wherein frequencies between zero and at least 1.6 kHz equivalent to two times the typical frequency range of the speech, are retained to ensure that at least one harmonic is obtained to prevent confusion in determining the fundamental frequency, means for applying a 256-point second DFT directly over the amplitude of the first DFT to produce quasi-time domain-transformed samples without taking the logarithm of the squared amplitude, means for applying a weighted average to the time domain-transformed samples, wherein at least two samples are combined to produce a single sample, and means for searching the average time domain-transformed samples to find at least one peak, wherein the position of the highest peak represents the estimated pitch lag in the current pitch analysis window; and speech output means for outputting speech reproduced according to the estimated pitch lag value.

24. The apparatus of claim 23, further comprising:

means for defining a previous pitch analysis window having an associated pitch lag value;

means for linearly interpolating the lag values of the current pitch analysis window and the previous pitch analysis window to produce plural interpolated pitch lag values; and means for refining the plural interpolated lag values.

25. The apparatus of claim 24, wherein the plural interpolated lag values are refined according to analysis-by-synthesis, wherein a reduced search is performed within ±5 samples of each of the plural interpolated pitch lag values.

26. The apparatus of claim 23, further comprising means for refining the estimated pitch lag value according to analysis-by-synthesis, wherein a reduced search is performed within ±5 samples of the estimated pitch lag value.

27. The apparatus of claim 23, further comprising means for applying a homogeneous transformation to the amplitude of the first DFT.

28. The apparatus of claim 27, wherein the amplitude of the first DFT is squared.

29. The apparatus of claim 27, wherein the logarithm of the amplitude of the first DFT is used.

30. The apparatus of claim 23, wherein the DFT is a fast Fourier transform (FFT) having an associated length, and the computer further includes means for downsampling the N LPC residual samples for representation by fewer samples X; and means for scaling the pitch lag value such that the scaled lag value $$\mathrm{Lag}_{scaled} = \frac{N}{X} * \text{Estimated pitch lag value},$$

wherein X is determined according to the length of the FFT.

31. A method of estimating pitch lag for quantization and compression of speech representing voiced and unvoiced speech within a typical frequency range of zero to 800 Hz having a fundamental frequency, the speech being represented by a linear predictive coding (LPC) residual which is defined by a plurality of LPC residual samples, wherein the estimation of a current LPC residual sample is determined in the time domain according to a linear combination of past samples, the method comprising the steps of:

applying a first discrete Fourier transform (DFT) to the LPC residual samples, the first DFT having an associated amplitude;

squaring the amplitude of the first DFT, the squared amplitude having high and low frequency components;

filtering out the high frequency components of the squared amplitude in the frequency domain, wherein frequencies between zero and at least 1.6 kHz are retained to ensure that at least on harmonic is obtained to accurately determine the fundamental frequency;

applying a second DFT directly over the filtered square amplitude of the first DFT without taking the logarithm of the squared amplitude, to produce time domain-transformed LPC residual samples;

determining an initial pitch lag value according to the time domain-transformed LPC residual samples, the initial pitch lag value having an associated prediction error;

refining the initial pitch lag value using autocorrelation, wherein the associated prediction error is minimized; and coding the LPC residual samples according to the refined pitch lag value.

32. The apparatus of claim 31, further comprising a low pass filter for filtering high frequency components of the amplitude of the first DFT.

33. The method of claim 31, further comprising the steps of:

grouping the plurality of LPC samples into a current coding frame;

dividing the coding frame into multiple pitch subframes;

subdividing the pitch subframes into multiple coding subframes;

estimating initial pitch lag estimates $\mathrm{lag}_1$ and $\mathrm{lag}_2$ which represent the lag estimates, respectively, for the last coding subframe of each pitch subframe in the current coding frame;

estimating a pitch lag $\mathrm{lag}_0$ from the last coding subframe of the preceding coding frame;

refining the pitch lag estimate $\mathrm{lag}_0$;

linearly interpolating $\mathrm{lag}_1$, $\mathrm{lag}_2$, and $\mathrm{lag}_0$ to estimate pitch lag values of the coding subframes; and further refining the interpolated pitch lag of each coding subframe.

34. The method of claim 31, further comprising the step of downsampling the LPC residual samples to a downsampling value for approximate representation by fewer samples.

35. The method of claim 31, further comprising the step of scaling the initial pitch lag value according to the equation:

$$Lag_{scaled} = \frac{\text{Number } LPC \text{ residual samples}}{\text{Downsampling value}} * \text{Estimated pitch lag value.}$$

36. The system of claim 31, further comprising the steps of:

receiving the LPC residual samples;

processing the refined pitch lag value to reproduce the input speech as coded speech; and outputting the coded speech.

37. A speech coding method for reproducing and coding input speech operable with a computer system requiring substantially reduced complexity on the order of three times less complexity than standard autocorrelation systems, the speech representing voiced and unvoiced speech within a typical frequency range of zero to 800 Hz having a fundamental frequency, wherein the speech is represented by a linear predictive coding (LPC) excitiation signal defining the decoded LPC residual of the input speech, the method comprising the steps of:

processing the LPC residual and estimating an inital pitch lag of the LPC residual, wherein the pitch lag is between a minimum and maximum pitch lag value;

defining a current pitch analysis window having N LPC residual samples, wherein N is a least two times the maximum pitch lag value;

applying a 256-point first discrete Fourier transform (DFT) to the LPS residual samples in the current pitch analysis window, the first DFT having an associated amplitude spectrum having high and low frequency components;

filtering out the high frequency components of the amplitude spectrum of the first DFT in the frequency domain, wherein frequencies between zero and at least 1.6 kHz, equivalent to two times the typical frequency range of the speech, are retained to ensure that at least one harmonic is obtained to prevent confusion in determining the fundamental frequency;

applying a 256-point second DFT directly over the amplitude of the first DFT without taking the logarithm of the squared amplitude to produce time domain-transformed samples such that the time domain-transformed samples are real values and the spectrum phase information is preservered;

applying a weighted average to the time domain-transformed samples, wherein at least two samples are combined to produce a single sample; and searching the averaged time domain-transformed samples to find at least on peak, wherein the position of the highest peak represents the estimated pitch lag in the current pitch analysis window; and speech output means for outputting speech reproduced according to the estimated pitch lag value.

38. The method of claim 37, wherein the filter comprises a low pass filter for filtering high frequency components of the amplitude spectrum of the first DFT.

39. The method of claim 37, further comprising the steps of:

defining a previous pitch analysis window having an associated pitch lag value;

linearly interpolating the lag values of the current pitch analysis window and the previous pitch analysis window to produce plural interpolated pitch lag values; and refining the plural interpolated lag values.

40. The method of claim 39, wherein the plural interpolated lag values are refined according to analysis-by-synthesis, wherein a reduced search is performed within ±5 samples of each of the plural interpolated pitch lag values.

41. The method of claim 37, further comprising the step of refining the estimated pitch lag value according to analysis-by-synthesis, wherein a reduced search is performed within ±5 samples of the estimated pitch lag value.

42. The method of claim 37, further comprising the step of applying a homogeneous transformation to the amplitude of the first DFT.

43. The method of claim 37, wherein the amplitude of the first DFT is squared.

44. The method of claim 37, wherein the DFT is a fast Fourier transform (FFT) having an associated length, the method further comprising the steps of:

downsampling the N LPC residual samples for representation by fewer samples X; and scaling the pitch lag value such that the scaled lag value $$Lag_{scaled} = \frac{N}{X} * \text{Estimated pitch lag value,}$$

wherein X is determined according to the length of the FFT.

45. A speech coding method for reproducing and coding input speech representing voiced and unvoiced speech within a typical frequency range of zero to 800 Hz having a fundamental frequency, the method requiring substantially reduced complexity on the order of 1 million instructions per second (MIPS), three times less complexity than standard autocorrelation methods requiring at least 3 MIPS, the speech coding apparatus operable with a linear predictive coding (LPC) excitation signal defining the decoded LPC residual of the input speech, LPC parameters, and an innovation codebook representing pseudo-random signals which form a plurality of vectors which are referenced to excite speech reproduction to generate speech, the speech coding method comprising the steps of:

receiving and processing the input speech;

processing the input speech, wherein the step of processing includes:

determining the LPC residual of the input speech, determining a coding frame within the LPC residual, subdividing the coding frame into plural pitch subframes, defining a pitch analysis window having N LPC residual samples, the pitch analysis window extending across the pitch subframes, roughly estimating an initial pitch lag value for each pitch subframe, by applying a first discrete Fourier transform (DFT) to the LPC residual samples, the first DFT having an associated amplitude, squaring the amplitude of the first DFT, the squared amplitude having phase information and being represented by low and high frequency components, filtering out the high frequency components of the squared amplitude in the frequency domain to retain frequencies between zero and at least 1.6 kHz to ensure that at least one harmonic is found to accurately determine the fundamental frequency, applying a second DFT directly over the squared amplitude of the first DFT without taking the logarithm of the square amplitude to produce time domain-transformed LPC residual samples, the second DFT being a 256-point DFT such that the time domain-transformed LPC residual samples are real values, determining an initial pitch lag value according to the time domain-transformed LPC residual samples, dividing each pitch subframe into multiple coding subframes, such that the initial pitch lag estimate for each pitch subframe represents the lag estimate for the last coding subframe of each pitch subframe, and interpolating the estimated pitch lag values between the pitch subframes for determining a pitch lag estimate for each coding subframe, and refining the linearly interpolated lag values; and outputting speech reproduced according to the refined pitch lag values.

* * * * *